United States Patent [19]

Wissinger

[11] Patent Number: 4,671,026

[45] Date of Patent: Jun. 9, 1987

[54] BATHTUB WALL SURROUND KIT AND SEALS THEREFOR

[75] Inventor: John W. Wissinger, New Castle, Pa.

[73] Assignee: Universal-Rundle Corporation, New Castle, Pa.

[21] Appl. No.: 709,491

[22] Filed: Mar. 8, 1985

[51] Int. Cl.[4] ..... A47K 3/16

[52] U.S. Cl. ..... 52/35; 52/288; 52/417; 52/588; 4/614; 206/453

[58] Field of Search ..... 206/223, 321, 325, 453, 206/586; 52/34, 35, 261, 288, 390, 417, 588, 610; 4/609, 612, 614

[56] References Cited

U.S. PATENT DOCUMENTS

| | | | |
|---|---|---|---|
| 2,002,789 | 5/1935 | Niedechen | 4/612 |
| 2,068,098 | 1/1937 | Elmendorf | 52/417 |
| 3,194,396 | 7/1965 | Mock | 206/321 |
| 3,420,021 | 1/1969 | Anghinetti et al. | 52/588 |
| 3,545,795 | 12/1970 | Hertel | 52/417 |
| 3,688,459 | 9/1972 | Mattix | 52/34 |
| 4,080,710 | 3/1978 | Hess | 52/261 |
| 4,399,644 | 8/1983 | Bright | 52/288 |
| 4,569,171 | 2/1986 | Kuhr et al. | 52/288 |
| 4,578,832 | 4/1986 | Primucci | 4/614 |

*Primary Examiner*—Joseph Man-Fu Moy

*Assistant Examiner*—David T. Fidei

*Attorney, Agent, or Firm*—Wood, Dalton, Phillips, Mason & Rowe

[57] ABSTRACT

A bathtub wall surround kit and seals therefor. The kit includes a pair of end panels and a pair of side panels all of approximately uniform dimension for compact nesting during shipment and the side panels are adapted to be horizontally disposed with the upper panel in overlying relation to the lower panel. The kit also includes a pair of vertical seals for joining the confronting edges of the end panels and the side panels in substantially watertight fashion and a plurality of base seals for joining the bottom edges of the end panels and the lower one of the side panels to a rim of a bathtub in substantially watertight fashion. The kit further includes a pair of corner seals for joining a portion of the confronting edges of the end panels and the lower side panel in substantially watertight fashion and the corner seals are also adapted to join a portion of the bottom edges of the end panels and the lower side panel adjacent the confronting edges to the rim of the bathtub in substantially watertight fashion. With this arrangement, the bathtub wall surround kit and seals therefor eliminate the need for the installer to caulk the joints during or after installation.

12 Claims, 13 Drawing Figures

BATHTUB WALL SURROUND KIT AND SEALS THEREFOR

BACKGROUND OF THE INVENTION

The present invention relates to means for covering the end walls and side wall of a bathtub opening and, more particularly, relates to a bathtub wall surround kit and seals therefor to facilitate installation and maintenance.

In the past, various means for covering the end walls and side wall of a bathtub enclosure have been proposed. It has been common, for instance, for such walls to be covered with ceramic tile, although this is far less common today due to the fact that ceramic tile oftentimes requires extensive maintenance in the form of replacing and regrouting loose or missing tiles and is difficult to clean in a satisfactory fashion capable of removing soap residue and eliminating mildew without damaging the tile surface. More recently, bathtub wall surrounds have been formed of fiberglass or plastic to avoid these problems.

Conventional bathtub wall surrounds usually consist of either three or five pieces. The three piece wall surround usually includes a pair of L-shaped end panels and a single side panel whereas the five piece wall surround may include a pair of end panels, a pair of L-shaped corner panels and a side panel. With these arrangements, the panels are usually attached to the building walls with panel adhesive.

Unfortunately, with both three piece and five piece wall surrounds, the joints between the panels must be sealed with caulk. It is also necessary to caulk the joint between the wall panels and the rim of the tub in order to avoid water damage and to provide the requisite seal. However, caulk is difficult to apply, tends to mildew and dry out after several years, and must be replaced.

Other types of wall surrounds have included three panels which may be flat or formed with soap shelves, grab bars or surface decoration. The panels are then connected by a V-shaped plastic extrusion having a slot in each leg of the extrusion but, in order to make the surround watertight, it is necessary to caulk the joints between the panels and extrusions and, again, between the panels and the rim of the tub. Still other variations requiring caulk include a design where the side wall is in two pieces joined by an H-shaped plastic extrusion.

In addition to the problem of caulk for the joints, bathtub wall surrounds have usually been expensive to ship by reason of their configuration. In particular, with both the three piece wall surround and the five piece wall surround, the L-shaped configuration of the end panels and the corner panels, respectively, have made it necessary to use large shipping containers occupying an inordinate amount of shipping space compared to the weight of the wall surround. In addition, because the panels are vertically disposed, it has not been possible to form a long utility shelf area in the side wall.

In view of the above and other problems, it has remained to provide a bathtub wall surround requiring no caulk, permitting shipment in a small carton, and allowing formation of longer utility shelves.

SUMMARY OF THE INVENTION

A bathtub wall surround kit for the end walls and side wall of a bathtub opening. The kit includes a pair of end panels that are adapted to be secured to the end walls of the bathtub opening and have a greater height dimension than width dimension in the installed orientation thereof with the end panels being of approximately uniform height and width. The kit also includes a pair of side panels that are adapted to be secured to the side wall of a bathtub opening and have a greater width dimension and height dimension in the installed orientation thereof with the side panels being of approximately uniform width and height. Moreover, the pair of end panels and the pair of side panels may be substantially superposed for compact nesting during shipment.

In a preferred embodiment, a pair of vertical seals are provided for joining the confronting edges of the end panels and the side panels in substantially watertight fashion. One of the vertical seals is adapted to be disposed in each of the corners defined by the intersections of the end walls with the side wall and each of the seals is generally L-shaped having a pair of panel receiving channels. Moreover, each of the channels is defined by a pair of spaced apart walls and includes seal means associated with one of the walls.

One feature of the present invention includes the pair of side panels being formed so as to be installed as an upper side panel and a lower side panel. The upper side panel is advantageously adapted to be disposed in overlying relation to the lower side panel which preferably includes a horizontal offset forming a ledge in close proximity to the upper edge of the lower side panel. With this construction, the upper side panel is adapted to be disposed with the bottom edge thereof on the ledge formed by the horizontal offset of the lower side panel.

In the preferred embodiment, a plurality of base seals are provided for joining the bottom edges of the end panels and the lower one of the side panels to a rim of a bathtub in substantially watertight fashion. One of the base seals is adapted to be associated with the bottom edge of each of the end panels and the lower one of the side panels with each of the base seals having a panel receiving channel. Moreover, each of the channels is defined by a pair of spaced apart walls joined by a bottom wall and includes seal means associated with the bottom thereof.

Another feature of the present invention includes the width dimension of the side panels being substantially the same as the height dimension of the end panels. It is also advantageous for the combined height dimension of the side panels to be approximately the same as the height dimension of the end panels. By providing four panels of approximately the same dimension in generally planar form, the panels are well suited for compact nesting in containers for shipment.

Still another feature of the present invention includes a pair of corner seals provided for joining a portion of the confronting edges of the end panels and the lower side panel in substantially watertight fashion. The corner seals are also adapted to join a portion of the bottom edges of the end panels and the lower side panel adjacent the confronting edges thereof to a rim of a bathtub in substantially watertight fashion, and one of the corner seals is adapted to be disposed in each of the corners defined by the intersections of the end walls with the side wall and with the rim of the bathtub. Moreover, each of the corner seals has a depending leg formed of a flexible material to provide the substantially watertight seal when compressed against the rim of the bathtub.

Still other objects, advantages and features of the present invention will become apparent from a consideration of the detailed description when taken in conjunction with the accompanying drawings.

DETAILED DESCRIPTION OF THE PREFERRED EMBODIMENTS

Figure 1:
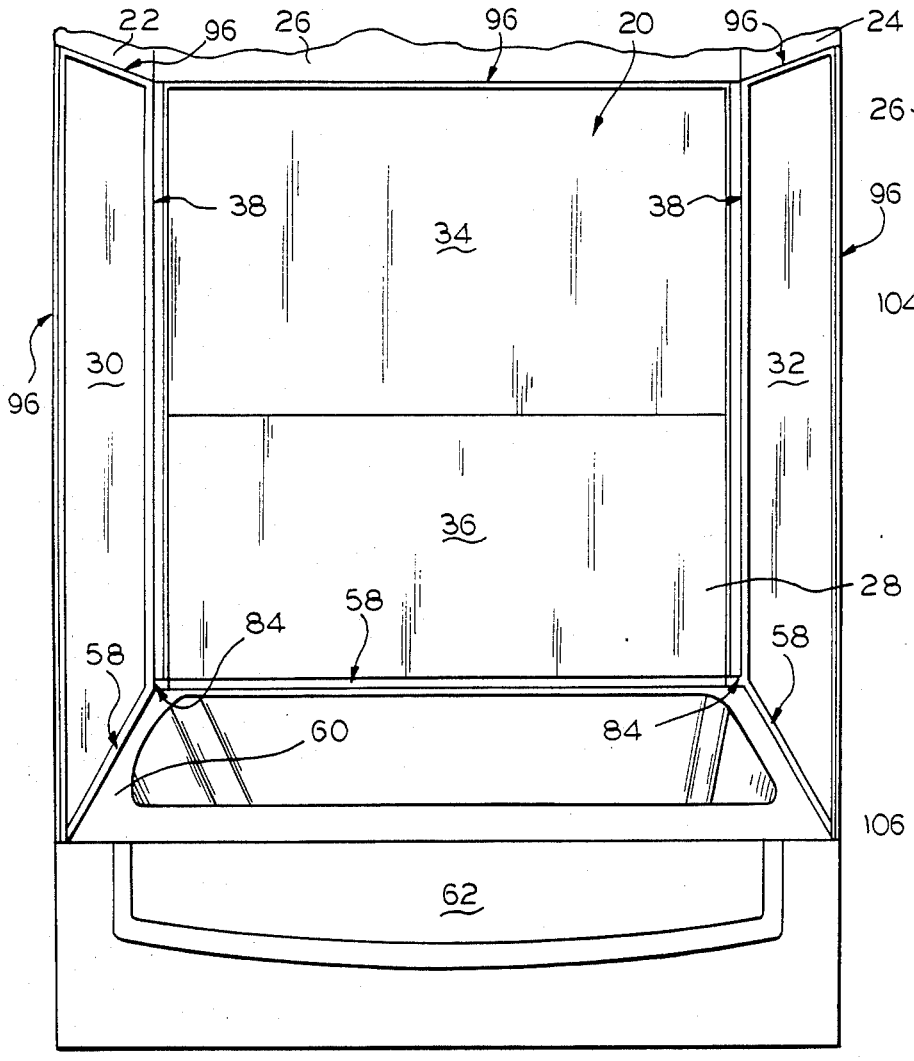
FIG. 1 is a perspective view of an installed bathtub wall surround kit in accordance with the present invention.

In the illustration given, and with reference first to FIG. 1, the reference numeral 20 designates generally a bathtub wall surround kit for the end walls 22 and 24 and side wall 26 of a bathtub opening 28, all in accordance with the present invention. The kit 20 includes a pair of end panels 30 and 32 that are adapted to be secured to the end walls 22 and 24, respectively, of the bathtub opening 28 and have a greater height dimension than width dimension in the installed orientation thereof with the end panels being of approximately uniform height and width. The kit 20 also includes a pair of side panels 34 and 36 that are adapted to be secured to the side wall 26 of the bathtub opening 28 and have a greater width dimension than height dimension in the installed orientation thereof with the side panels being of approximately uniform width and height. Moreover, in the preferred embodiment, the width dimension of the side panels 34 and 36 is approximately the same as the height dimension of the end panels 30 and 32 and the height dimension of the side panels 34 and 36 is approximately the same as the width dimension of the end panels 30 and 32 so that all of the panels 30, 32, 34 and 36 may be substantially superposed for compact nesting during shipment.

In an alternative embodiment, the dimensions of the panels may vary somewhat to accommodate soap shelves, grip bars or other features. In particular, the height dimension of the side panels 34 and 36 may be more and less, respectively, or vice versa, than the width dimension of the end panels 30 and 32. However, in either embodiment, the combined height dimension of the side panels 34 and 36 will approximate the height dimension of the end panels 30 and 32.

Figure 4:
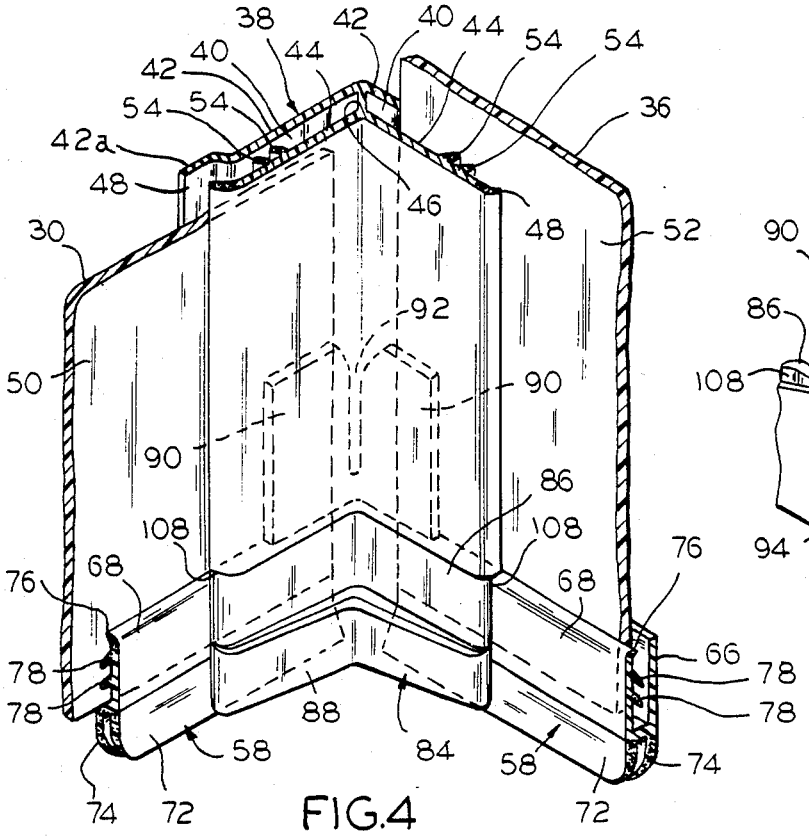
FIG. 4 is a front perspective view of a vertical seal, a pair of base seals, and a corner seal of the kit illustrated in FIG. 1.

Referring to FIGS. 1 and 4, a pair of vertical seals 38 are provided for joining the confronting edges of the end panels 30 and 32 and the side panels 34 and 36 in substantially watertight fashion. One of the vertical seals 38 is adapted to be disposed in each of the corners defined by the intersections of the end walls 22 and 24 with the side wall 26 (see FIG. 1) and each of the seals 38 is generally L-shaped in cross-section having a panel receiving channel 40 in each leg. Moreover, each of the channels 40 is defined by a pair of spaced apart walls 42 and 44 and includes seal means associated with one of the walls such as 44 (as will be described in detail hereinafter).

Figure 6:
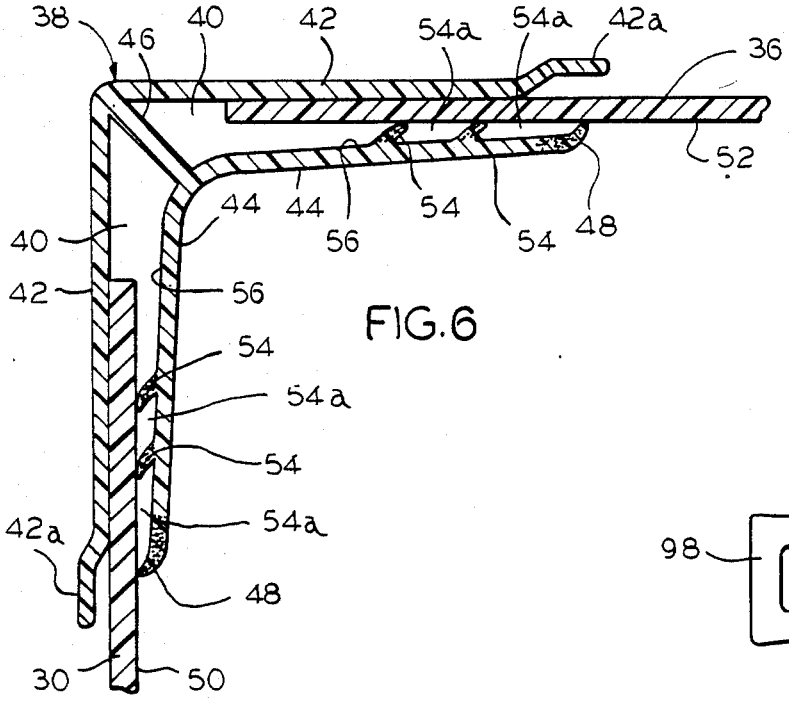
FIG. 6 is a cross-sectional view of a vertical seal of the kit illustrated in FIG. 1.

Referring to FIG. 6, the channels 40, which are each defined by a back wall 42 and a front wall 44, are adapted to receive the panels (as will be discussed in detail hereinafter). Each of the vertical seals 38 is formed such that the back walls 42 are integrally disposed at substantially a right angle to conform to one of the corners defined by the intersections of the end walls 22 and 24 with the side wall 26 defining the bathtub opening 28. Each of the vertical seals 38 is also formed such that the front walls 44 are integrally disposed at greater than a right angle to taper toward the corresponding one of the back walls 42 and are joined to the back walls 42 by means of a rib 46, either by means of an integral extrusion or by appropriate fastening means between the rib 46 and one or both of the walls. Moreover, the ends of the front walls 44 remote from the rib 46 are adapted for limited pivotal movement about the rib 46 toward and away from the corresponding ones of the back walls 42.

As shown in FIG. 6, the ribs 46 extend diagonally between the intersection of the back walls 42 and the intersection of the front walls 44 in each of the vertical seals 38. It will also be seen that the seal means, which preferably includes a flexible finger 48 extending from the end of each of the front walls 44 toward the corresponding one of the back walls 42, are integrally associated with the front walls 44. It will further be seen that the flexible finger 48 integrally associated with each of the front walls 44 extends toward an offset portion **42*a* of the back wall 42 to a point rearwardly of the plane of the outwardly facing surface of the back wall 42 prior to assembly. With this construction, the flexible fingers 48 are adapted to sealingly engage the outwardly facing surfaces such as 50 and 52 of the end and side panels such as 30 and 36** in watertight fashion to form a primary seal.

Figure 8:
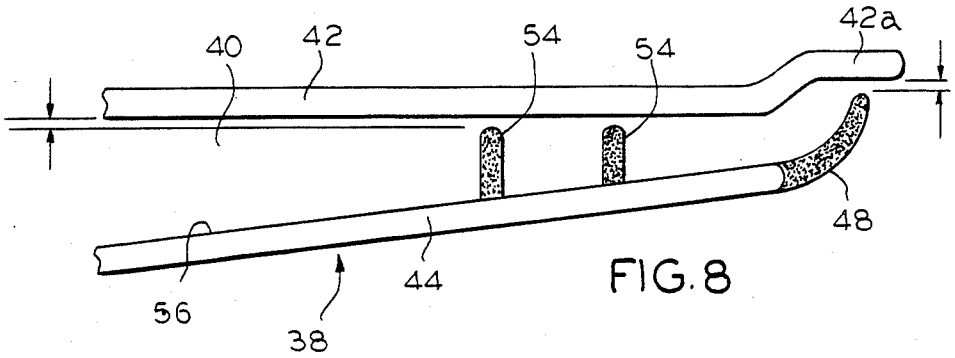
FIG. 8 is a partial end view of a vertical seal of the kit illustrated in FIG. 1.

Still referring to FIG. 6, the seal means also includes a plurality of flexible fingers 54 extending from the inner surface 56 of each of the front walls 44 toward the corresponding one of the back walls 42. The flexible fingers 54 are adapted to sealingly engage the outwardly facing surfaces such as 50 and 52 of the end and side panels such as 30 and 36 in watertight fashion to form a secondary seal. As will be appreciated, the primary seals 48 extend from the ends of the front walls 44 and curve toward the back walls 42 and the secondary seals 54 extend from the inner surfaces 56 of the front walls 44 generally perpendicular to the back walls 42 (see FIG. 8).

While the exact materials are not critical, the back walls 42, front walls 44 and ribs 46 are preferably formed of a rigid or semi-rigid plastic material. It is also advantageous for the flexible fingers 48 and 54 forming the primary and secondary seals, respectively, to be formed of a flexible material. By utilizing such materials, the vertical seals 38 are well suited for the intended function.

Figure 3:
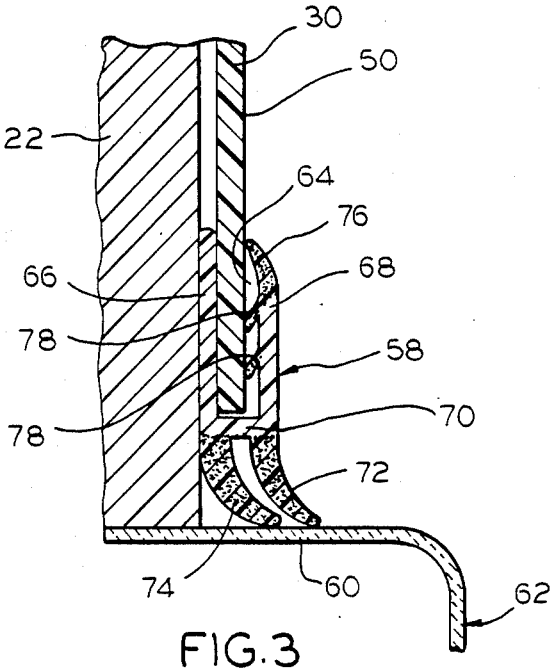
FIG. 3 is a cross-sectional view a base seal of the kit illustrated in FIG. 1.
Figure 9:
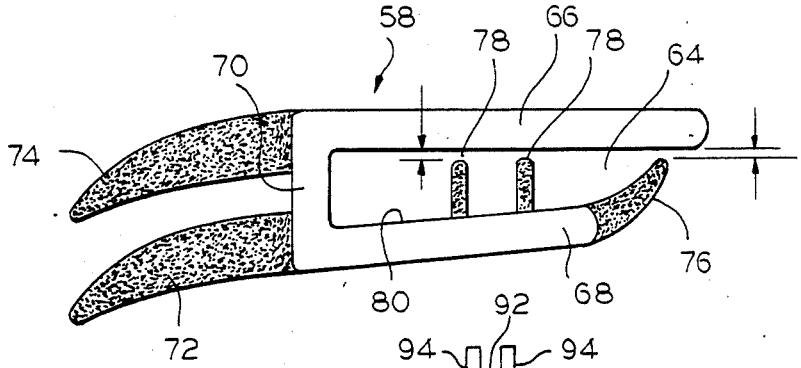
FIG. 9 is an end view of a base seal of the kit illustrated in FIG. 1.
Figure 10:
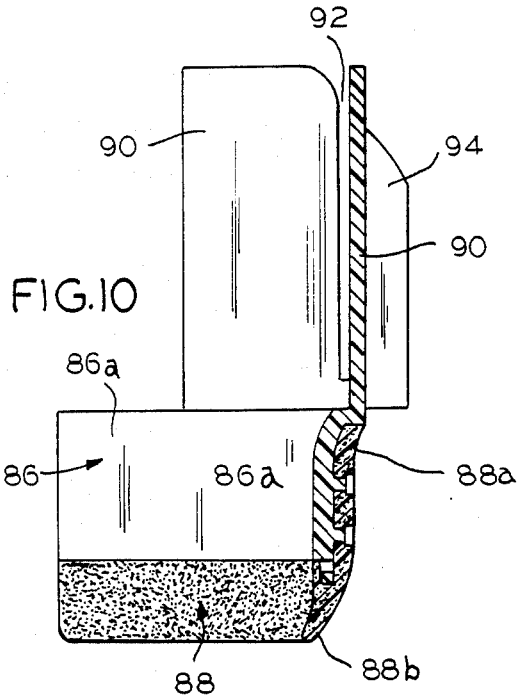
FIG. 10 is an end view of a corner seal of the kit illustrated in FIG. 1.

Referring to FIGS. 1 and 3, a plurality of base seals 58 are provided for joining the bottom edges of the end panels 30 and 32 and the lower one of the side panels 36 to a rim 60 of a bathtub 62 in substantially watertight fashion. In particular, one of the base seals 58 is adapted to be associated with the bottom edge of each of the end panels 30 and 32 and the lower one of the side panels 36 and to extend substantially entirely along the bottom edge thereof into the area where the channels 40 of the vertical seals 38 receive the confronting edges of the end panels 30 and 32 and the side panels 34 and 36. As shown in FIGS. 3 and 9, the base seals 58 each include a panel receiving channel 64 having seal means associated with the bottom thereof (as will be described in detail hereinafter).

Still referring to FIGS. 3 and 9, the channels 64 are each defined by a pair of spaced apart side walls 66 and 68 joined by a bottom wall 70. The pairs of spaced apart side walls includes a back wall 66 and a front wall 68 disposed in substantially parallel relation with the bottom wall 70 joining the back wall 66 to the front wall 68 for limited movement of the front wall 68 relative to the back wall 66, and the seal means includes at least one flexible finger 72 extending downwardly from the bottom wall 70 of each of the base seals 58. As will be seen, the flexible fingers 72 sealingly engage the rim 60 of the bathtub 62 in substantially watertight fashion to form a primary seal.

As shown in FIGS. 3 and 9, the seal means may also include a second flexible finger 74 extending downwardly from the bottom wall 70 of each of the base seals 58 rearwardly of the flexible finger 72 forming the primary seal to sealingly engage the rim 60 of the bathtub 62 in substantially watertight fashion to form a secondary seal. It will also be appreciated that the seal means includes a flexible finger 76 extending from the ends of the front walls 68 toward the corresponding one of the back walls 66 to sealingly engage the outwardly facing surface such as 50 of the corresponding one of the end or side panels such as 30 in substantially watertight fashion to form a primary seal. Finally, the seal means may also include a plurality of flexible fingers 78 extending from the inner surface 80 of the front wall 68 toward the back wall 66 in each of the base seals 58 to sealingly engage the outwardly facing surface such as 50 of the end or side panels such as 30 in substantially watertight fashion to form a secondary seal.

With this construction, the primary seals 76 extending from the ends of the front walls 68 curve toward the back walls 66 in each of the base seals 58. It will also be appreciated that the secondary seals 78 extend from the inner surface 80 of the front walls 68 generally perpendicular to the back walls 66 in each of the base seals 58 (see FIG. 9). With the primary seals 72 and 76 and the secondary seals 74 and 78 being formed of a flexible material, the back walls 66, front walls 68 and bottom walls 70 are advantageously formed of a rigid or semi-rigid plastic material in each of the base seals 58.

Figure 2:
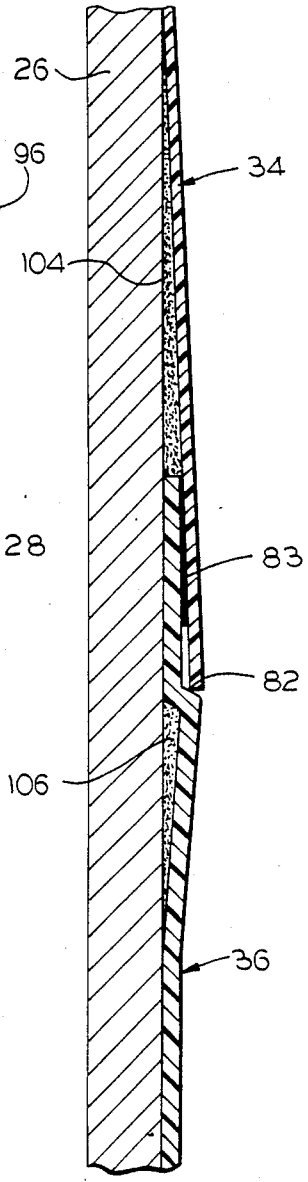
FIG. 2 is a cross sectional view of the joint between the upper and lower side panels of the kit illustrated in FIG. 1.

As previously indicated, the pair of side panels includes an upper side panel 34 adapted to be disposed in overlying relation to the lower side panel 36 (see FIGS. 1 and 2). The lower side panel 36 includes a generally horizontal offset forming a ledge as at 82 in close proximity to the upper edge of the lower side panel, and it will be seen that the upper side panel 34 is adapted to be disposed with the bottom edge thereof on the ledge 82 formed by the horizontal offset of the lower side panel 36. As will be appreciated, the panels 34 and 36 will be formed such that the amount of overlap therebetween will prevent water from seeping behind the panels 34 and 36.

In addition, to aid in preventing water from seeping behind the panels 34 and 36, a strip of double faced tape 83 is advantageously utilized. It will be seen by referring to FIG. 2 that the double faced tape 83 will join the panels 34 and 36 at the joint defined by the lap of the panel 34 over the panel 36 at a point above the ledge 82. By utilizing the double faced tape 83 as shown, a watertight joint is readily ensured and the installation is rendered easier to make.

Referring to FIGS. 4, 5 and 10 through 13, a pair of corner seals 84 are provided for joining a portion of the confronting edges of the end panels such as 30 and the side panels such as 36 in substantially watertight fashion. The corner seals 84 are also adapted to join a portion of the bottom edges of the end panels such as 30 and the side panel such as 36 to the rim 60 of the bathtub 62 in substantially watertight fashion. In particular, the pair of corner seals 84 are provided so that one of the seals is adapted to be disposed in each of the corners defined by the intersections of the end walls 22 and 24 and side wall 26 with the rim 60 of the bathtub 62.

Figure 12:
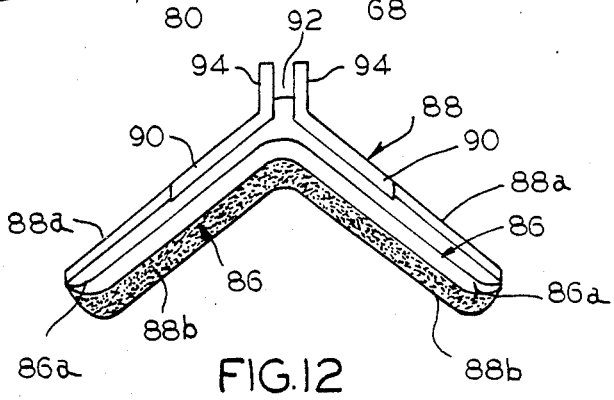
FIG. 12 is a top view of a corner seal of the kit illustrated in FIG. 1.
Figure 13:
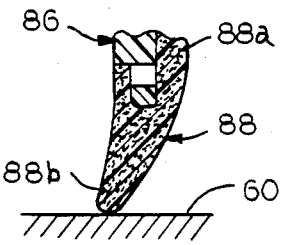
FIG. 13 is a partial end view of a corner seal of the kit illustrated in FIG. 1.
Figure 11:
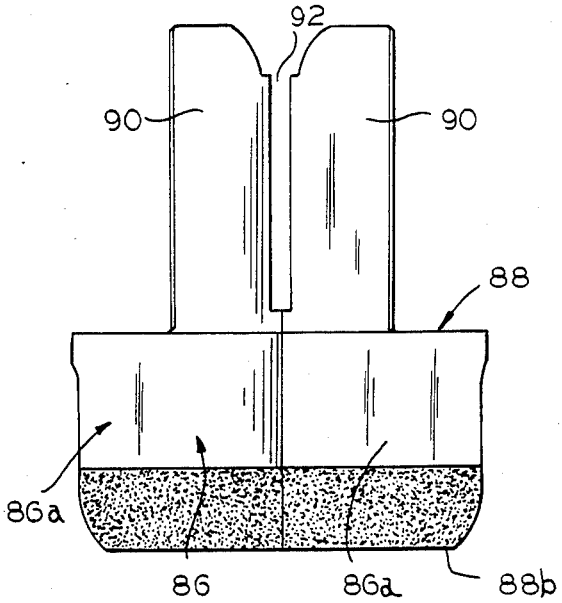
FIG. 11 is a front perspective view of a corner seal of the kit illustrated in FIG. 1.

As will be appreciated by referring to FIGS. 11 and 12, each of the corner seals 84 has a generally L-shaped outwardly facing wall 86 adapted to be disposed in one of the corners defined by the intersections of the end walls 22 and 24 with the side wall 26 of the bathtub opening 28. The outwardly facing walls 86 are preferably formed of a rigid or semi-rigid plastic material and have a depending leg 88 (see FIG. 10) formed of flexible material to provide the substantially watertight seal when compressed against the rim 60 of the bathtub 62 (see FIG. 13) with each of the depending legs 88 including a first portion **88*a* covering the back of the outwardly facing wall 86 and a second portion 88*b* extending downwardly from the bottom of the outwardly facing wall 86 (see FIG. 10). In addition, the corner seals 84 each include means for locating and retaining the corner seal in compressed sealing engagement with the rim 60 of the bathtub 62 in one of the corners defined by the intersections of the end walls 22 and 24 with the side wall 26 of the bathtub opening 28**.

In particular, the locating and retaining means includes an upstanding vertical leg 90 associated with each of the outwardly facing wall portions **86*a*. The vertical legs 90 extend from the tops of the outwardly facing wall portions 86*a* in planes lying generally perpendicular to one another and include a slot 92 between the legs 90 associated with the outwardly facing wall portions 86*a* together with an inwardly disposed vertical rib 94 along the edge of each of the legs 90 adjacent the slot 92. Moreover, as with the seals 38 and 58, the corner seals 84 are preferably formed such that the outwardly facing wall portions 86*a*, the legs 90 and the ribs 94 are integrally molded of a rigid or semi-rigid plastic material with the depending legs 88** being formed of a flexible material.

Figure 7:
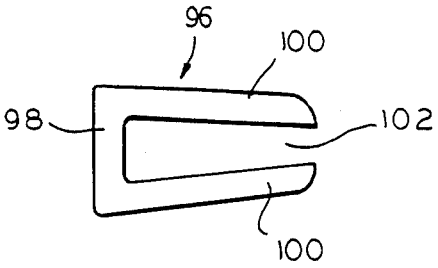
FIG. 7 is an end view of an edge extrusion of the kit illustrated in FIG. 1.

Referring to FIG. 7, an edge extrusion 96 is illustrated and is provided for finishing the kit 20. It will be seen that the edge extrusion 96 is formed with a back wall 98 having a pair of inwardly converging side walls 100 extending from the ends thereof to define a panel receiving channel 102. As will be appreciated, the edge extrusion 96 is provided to cover the unfinished edges of the end panels 30 and 32 and the side panel 34 not otherwise covered by one of the seals 38, 58 and 84 (see, also, FIG. 1).

With the present invention, the end panels 30 and 32 may be flat or formed to contain soap shelves, safety grab bars and/or decorative surfaces and may be identical or formed to contain different features and/or decorations. It should also be noted that the upper and lower side panels 34 and 36 may be flat or formed to contain the same or different features and/or decorations. In addition, the upper and lower side panels 34 and 36 may, if desired, be formed in the same manner as the end panels 30 and 32 to achieve still additional economies in manufacture by utilizing completely interchangeable panels.

Referring to FIG. 2, it will be appreciated that in a preferred embodiment of the invention the upper and lower side panels 34 and 36 are preferably fastened to the side wall 26 of the bathtub opening 28 by means of panel adhesive as at 104 and 106, respectively. The panel adhesive as at 104 and 106 bonds the upper and lower side panels 34 and 36, respectively, to the side wall 26 and the overlap of the upper side panel 34 relative to the lower side panel 36 prevents water from seeping behind the panels which could otherwise cause damage to the side wall 26. In a preferred embodiment of the invention, the upper side panel 34 overlaps the lower side panel 36 by approximately one and one-half inches and rests on the ledge 82 defined by the horizontal offset in the lower side panel 36, but double-faced tape 83 will advantageously be used in addition to or instead of the ledge 82.

Referring to FIG. 3, the flexible finger 76, which is preferably formed of plastic, acts as a primary seal. This prevents water from entering the channel 64 defined by the extrusion comprising the base seal 58, and the interior flexible fingers 78 act as secondary seals to trap water that may get past the primary seal 76. In addition, the flexible fingers 72 and 74, which also may be formed of plastic, provide primary and secondary seals, respectively. The downwardly extending flexible fingers 72 and 74 press against the rim 60 of the bathtub 62 to prevent water from seeping behind the end panels 30 and 32 and lower side panel 36 into the end walls 22 and 24 and side wall 26 of the bathtub opening 28. As a result, no caulk or other sealing material is required between the bathtub wall surround 20 and the tub 62 to render the installation waterproof.

Referring to FIG. 6, the flexible fingers 48, which are preferably formed of plastic, act as a primary seal. This prevents water from entering the channels 40 defined by the corner extrusions or vertical seals 38, and the interior flexible fingers 54 act as secondary seals to catch water that may get past the primary seals 48. As will be appreciated, water that enters the channels between the fingers 54 drains out of the bottom of the vertical seals 38 into the bathtub 62 through a channel between the vertical seals 38 and the base seals 58. The interior flexible fingers 54 are set into position by fully inserting the end panels 30 and 32 and side panels 34 and 36 into the channels 40 and then slightly withdrawing the end panels 30 and 32 and side panels 34 and 36. Alternatively, a pencil or other device may be inserted between the end panels 30 and 32 and side panels 34 and 36 and the front walls 44 and run the length of the vertical seals 38.

Referring to FIGS. 4 and 6, the end panels 30 and 32 and side panels 34 and 36 are adjustable within the limits of the depth of the channels 40 and placement of the interior flexible fingers 54 to suit installation requirements. It will also be appreciated that the corner seals 84 are formed of a rigid or semi-rigid plastic material with a flexible closed cell foam or other soft material such as rubber attached to it to form the depending leg 88 which provides a seal while allowing the end panels 30 and 32 and the lower side panel 36 to be adjusted in and out to fit the installation requirements. It will further be appreciated that the depending leg 99 of the seal 84 presses against the rim 60 of the bathtub 62 to provide the seal and, in conjunction with the base seal 58, prevents water from seeping behind the bathtub wall surround 20 at the corners defined by the intersections of the end walls 22 and 24 with the side wall 26 and with the rim 60 of the bathtub 62. While the corner seals 84 are adapted to be mechanically retained in sealing position, some installations may require a solvent or adhesive to bond the corner seals 84 to the base seals 58 for a permanent sealing installation.

Figure 5:
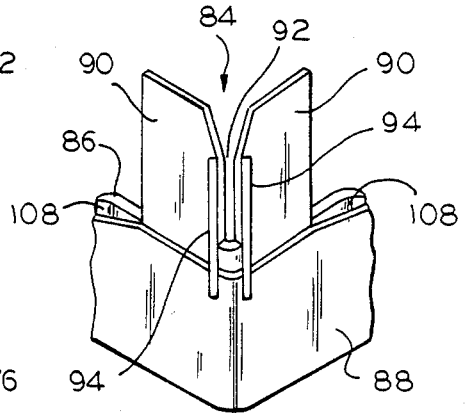
FIG. 5 is a rear perspective view of a corner seal of the kit illustrated in FIG. 1.

Referring to FIGS. 4 and 5, the corner seals 84 include drain channels defined by downwardly angled cutouts of the first portions **88*a* of the depending legs 88 that are adapted to be disposed under the interior flexible fingers 54 of the vertical seals 38. With this arrangement, the channels 54*a* (see FIG. 6) between the flexible fingers 48 and 54 are located such that any water that penetrates beyond the primary seals defined by the flexible fingers 48 will travel down the channels 54*a* and out the drain channels 108 back into the tub 62. As will also be appreciated the vertical legs 90 are adapted to be disposed in the channels 40 between the inwardmost flexible fingers 54 and the ribs 46 with the ribs 46 disposed in the slots 92 such that the vertical ribs 94 are disposed in adjacent parallel relation to the ribs 46**.

With the present invention, the bathtub wall surround kit 20 includes built-in seals that eliminate the need for the installer to caulk the joints after installation. Most conventional wall surrounds require the installer to run a bead of caulk along each joint in the wall surround and between the bathtub and wall surround which requires a great deal of skill that many do-it-yourselfers and professional installers do not have. As a result, the installation is often less than satisfactory upon completion and, in any event, the caulk tends to mildew and dry out after a period of years requiring recaulking every two to four years.

However, with the seals 38, 58 and 84, the need to caulk a wall surround has been eliminated. The wall panels may now be joined together by dual durometer plastic extrusions made from rigid or semi-rigid and flexible plastics whose external and internal flexible sealing fingers provide the necessary seals. In addition, there are dual durometer plastic extrusions that provide a seal between the wall panels and the tub.

Another unique feature of the present invention are the side panels. They consist of two horizontal pieces, either of which may contain soap or utility shelves and/or safety grab bars and, by dividing the wall horizontally, it is possible to form longer utility shelf areas than normally found in wall surrounds that have more than three pieces, i.e., two end panels and a single side panel. Moreover, the wall surround may be shipped in a smaller carton then would be possible with a single piece side panel.

Various changes coming with the spirit of the present invention may suggest themselves to those skilled in the art. Hence, it will be understood that the invention is not to be limited to the specific embodiments shown and described or the used mentioned. On the contrary, the specific embodiments and uses are intended to be merely exemplary with the present invention being limited only by the true spirit and scope of the appended claims.

I claim:

1. A bathtub wall surround kit, comprising:

a pair of end panels adapted to be secured to the end walls of a bathtub opening;

at least one side panel adapted to be secured to the side wall of a bathtube opening;

a pair of vertical seals for joining the confronting edges of said end panels and said side panel in substantially watertight fashion, on of said vertical seals being adapted to be disposed in each of the corners defined by the intersections of the end walls with the side wall, each of said vertical seals being generally L-shaped and including a pair of panel receiving channels, each of said channels being defined by a pair of spaced apart walls and including seal means associated with one of the walls;

each of said pairs of spaced apart walls of each of said vertical seals including a back wall and a front wall, each of said vertical seals having said back walls integrally disposed at substantially a right angle to conform to one of the corners defined by the intersections of the end walls with the side wall, each of said vertical seals having one of said front walls integrally disposed relative to the other of said front walls at greater than a right angle such that each of said front walls tapers toward the corresponding one of said back walls, each of said vertical seals being formed such that each of said front walls is movable toward and away from the corresponding one of said back walls, each of said vertical seals also being formed such that said seal means includes a flexible finger extending from the end of each of said front walls toward the corresponding one of said back walls, said flexible fingers being adapted to sealingly engage the outwardly facing surfaces of said side panel and said end panels in substantially watertight fashion to form a primary seal;

said primary seals extending from the ends of said front walls and curving toward said back walls of said vertical seals, each of said vertical seals being formed such that said front walls and said back walls are of a rigid plastic material and said flexible fingers forming said primary seals are formed of a flexible material, each of said vertical seals being formed such that said flexible material of said primary seals is integrally associated with said rigid material of said front walls thereof;

a base seal for joining the bottom edges of said end panels and said side panel to a rim of a bathtub in substantially watertight fashion, said base seal being adapted to be associated with the bottom edge of each of said end panels and said side panel, said base seal including a panel receiving channel having seal means associated with the bottom thereof, said channel being defined by a pair of spaced apart side walls joined by a bottom wall;

said pair of spaced apart side walls defining said channel in said seal including a back wall and a front wall disposed in substantially parallel relation, said bottom wall joining said front wall to said back wall for limited movement of said front wall relative to said back wall, said seal means including at least one flexible finger extending downwardly from the bottom wall of said base seal, said flexible finger being adapted to sealingly engage the rim of the bathtub in substantially wateright fashion to form a primary seal, said seal means also including a flexible finger extending from the end of said front wall toward the corresponding one of said back walls, said flexible finger being adapted to sealingly engage the outwardly facing surface of the corresponding one of said end panels and said side panel in substantially watertight fashion to form a primary seal, said primary seal extending from the end of said front wall curving toward said back wall of said base seal, said front wall and said back wall and said bottom wall of said base seal being formed of a rigid material and said flexible fingers forming said primary seals being formed of a flexible material, said flexible material of said primary seals being integrally associated with said rigid material of said bottom wall and said front wall of said base seal.

2. The bathtub wall surround kit as defined by claim 1 wherein each of said vertical seals includes a rib joining said front walls to said back walls for limited movement of said front walls relative to said back walls, one of said ribs extending diagonally between the intersection of said back walls and the intersection of said front walls in each of said vertical seals.

3. The bathtub wall surround kit as defined by claim 2 wherein said seal means includes a plurality of flexible fingers extending from the inner surface of each of said front walls toward the corresponding one of said back walls, said flexible fingers being adapted to sealingly engage the outwardly facing surfaces of said side panel and said end panels in substantially watertight fashion to form secondary seals extending from the inner surfaces of said front walls generally perpendicular to the corresponding one of said back wall of said vertical seals.

4. The bathtub wall surround kit as defined by claim 3 wherein said ribs of said vertical seals are also formed of a rigid material and said flexible fingers forming said secondary seals are formed of a flexible material integrally associated with said rigid material of said front walls.

5. The bathtub wall surround kit as defined by claim 1 wherein said seal means includes a second flexible finger extending downwardly from the the bottom wall of said base seal, said second flexible finger being disposed rearwardly of said flexible finger forming said primary seal and sealingly engaging the rim of the bathtub in substantially watertight fashion to form a secondary seal.

6. The bathtub wall surround kit as defined by claim 5 wherein said seal means includes a plurality of flexible fingers extending from the inner surface of said front wall toward said back wall in said base seal, said flexible fingers being adapted to sealingly engage the outwardly facing surfaces of said end panels and said side panel in substantially watertight fashion to form a secondary seal, said secondary seals extending from the inner surface of said front wall generally perpendicular to said back wall in said base seal.

7. The bathtub wall surround kit as defined by claim 6 wherein said flexible fingers forming said secondary seals are formed of a flexible material integrally associated with said rigid material of said front wall.

8. The bathtub wall surround kit as defined by claim 1 including a pair of corner seals for joining a portion of the confronting edges of said end panels and said side panel in substantially watertight fashion, said pair of corner seals also being adapted to join a portion of the bottom edges of said end panels and said side panel adjacent the confronting edges thereof to a rim of a bathtub in substantially water fashion, one of said corner seals being adapted to be disposed in each of the corners defined by the intersections of the end walls with the side wall and with the rim of the bathtub, each of said corner seals having a generally L-shaped outwardly facing wall adapted to be disposed in one of the corners defined by the intersections of the end walls with the side wall and with the rim of the bathtub, each of said outwardly facing walls being formed of a rigid material and having an integrally associated depending leg formed of a flexible material to provide a substantially watertight seal when compressed against the rim of the bathtub, each of said corner seals also including means for locating and retaining said corner seal in one of the corners defined by the intersections of the end walls with the side wall and with the rim of the bathtub.

9. The bathtub wall surround kit as defined by claim 2 wherein said end panels have a greater height dimension than width dimension in the installed orientation thereof, said pair of end panels being of approximately uniform height and width for compact nesting during shipment, and including a pair of side panels having a greater width dimension than height dimension in the installed orientation thereof, said pair of side panels being of approximately uniform width and height for compact nesting during shipment, said width dimension of said side panels being approximately the same as said height dimension of said end panels and the combined height dimension of said side panels approximating said height dimension of said end panels, said pair of side panels including an upper side panel and a lower side panel, said upper side panel being adapted to be disposed in overlying relation to said lower side panel, said lower side panel including a horizontal offset forming a ledge in close proximity to the upper edge of said lower side panel, said upper side panel being adapted to be disposed with the bottom edge thereof on said ledge formed by said horizontal offset of said lower side panel.

10. The bathtub wall surround kit as defined by claim 8 wherein each of said corner seals includes means for locating and retaining said corner seal in one of the corners defined by the intersections of the end walls with the side wall, said locating and retaining means including an upstanding vertical leg associated with each of a pair of outwardly facing wall portions defining said outwardly facing wall, said vertical legs extending from the tops of said outwardly facing wall portions in planes lying generally perpendicular to one another, and including a slot between said legs associated with said outwardly facing wall portions and an inwardly disposed vertical rib along the edge of each of said legs adjacent said slot.

11. The bathtub wall surround kit as defined by claim 10 wherein each of said depending legs includes a first portion covering the backs of said outwardly facing wall portions and a second portion extending downwardly from the bottom of said outwardly facing wall portions, said outwardly facing wall portions, said legs and said ribs being integrally molded of a rigid plastic material and said depending legs being formed of a flexible material.

12. The bathtub wall surround kit as defined by claim 9 including a strip of double faced tape for joining said upper side panel to said lower side panel in watertight fashion, said double faced tape adapted to be disposed between said upper side panel and said lower side panel above said ledge.

* * * * *